United States Patent [19]

Kehren et al.

[11] 4,148,674

[45] Apr. 10, 1979

[54] TERNARY EXPLOSIVE COMPOSITIONS

[75] Inventors: Jean-Paul A. Kehren, Angouleme; Robert A. Ousset, Sorgues, both of France

[73] Assignee: Societe Nationale des Poudres et Explosifs, Paris, France

[21] Appl. No.: 873,130

[22] Filed: Jan. 30, 1978

[30] Foreign Application Priority Data

Feb. 7, 1977 [FR] France ..... 77 03392

[51] Int. Cl.[2] ..... C06B 45/00

[52] U.S. Cl. ..... 149/2; 149/21; 149/92; 149/105; 149/111

[58] Field of Search ..... 149/2, 92, 21, 105, 149/111

[56] References Cited

U.S. PATENT DOCUMENTS 3,737,349 6/1973 Levenson ..... 149/105 X

*Primary Examiner*—Stephen J. Lechert, Jr.

*Attorney, Agent, or Firm*—Bucknam and Archer

[57] ABSTRACT

Ternary explosive compositions of the "hexolite" type are described in which a part of the hexogen is replaced by dinitroglycoluril. The modified hexolites obtained have enhanced shattering properties and are less expensive than conventional hexolites containing the same proportion of trinitrotoluene. Fine octogen and/or hexo-octo, as well as conventional hexolite modifiers, can be incorporated into the compositions.

The compositions according to the invention have the same applications as conventional hexolites.

5 Claims, No Drawings

TERNARY EXPLOSIVE COMPOSITIONS

The present invention is concerned with ternary explosive compositions having very good shattering properties.

Explosive compositions based on trinitrotoluene (or TNT) and on hexogen (or RDX), which appeared in the period between the two wars, are now well known. They are called hexolites or cyclotols and are characterised by their good shattering properties and their ease of processing, especially by casting.

We have previously made significant improvements in hexolites which increased the detonation rate and the degradation resistance, for example by replacing the finest fraction of the hexogen in a conventional hexolite by octogen or hexo-octo having a fine particle size, as described in French Pat. No. 2,182,599.

However, hexogen and octogen are relatively expensive explosives and it would be desirable to be able to replace them in hexolites, at least in part, by crystalline explosives which have a high detonation rate and are less expensive. In this respect, pentrite is not suitable because it imparts to compositions in which it is present substantially poorer shattering properties and much greater sensitivity to impact than in the case of hexogen compositions containing the same proportion of crystalline explosives.

We have now found that mixtures comprising trinitrotoluene, hexogen and dinitroglycoluril have shattering properties which are as good as, or even better than, those of hexolites having the same proportion of trinitroltoluene, and such dinitroglycoluril-containing compositions are less expensive than such hexolites.

According to the present invention, therefore, there is provided an explosive composition which comprises trinitrotoluene, hexogen and dinitroglycoluril.

Preferred compositions according to the invention contain, by weight, from 10 60% of trinitrotoluene, from 10 to 85% of hexogen, and from 5 to 50% of dinitroglycoluril.

Dinitroglycoluril or DINGU is a compound of the formula:

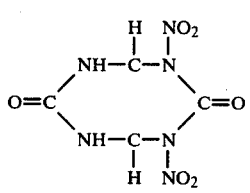

The explosive properties of DINGU are described in French Pat. No. 2,238,703. Its detonation rate of 7,580 m/second, determined on a fuse having a silver sheath of 4 mm external diameter and for a charge density of 1.76, means that this explosive has shattering properties which are inferior to those of pentrite.

For this reason, it is entirely surprising that the incorporation of DINGU into a hexolite substantially enhances its shattering properties, as shown in Table I (of the compositions given in this Table, only those of Examples 6 and 7 are in accordance with the invention):

TABLE I

| Ex. No. | TNT (%) | Hexogen (%) | DINGU (%) | Detonation rate (km/second) | Density | Shattering Properties (1) |
|---|---|---|---|---|---|---|
| 1 | 60 | 40 | — | 7.520 | 1.69 | 95.6 |
| 2 | 60 | — | 40 | 7.330 | 1.73 | 93.0 |
| 3 | 36.9 | 63.1 | — | 7.840 | 1.73 | 106.3 |
| 4 | 30 | — | 70 | 7.500 | 1.81 | 101.8 |
| 5 | 26.4 | 73.6 | — | 8.098 | 1.74 | 114.1 |
| 6 | 26.7 | 56.9 | 16.4 | 8.072 | 1.769 | 115.3 |
| 7 | 37.6 | 32.2 | 30.2 | 7.744 | 1.770 | 106.1 |

(1) equal to the product:density × (detonation rate)$^2$

The invention is applicable to both cast and compressed charges. For the latter, a relatively small proportion of trinitrotoluene, preferably about 10%, is advantageously used.

The invention is also applicable to the ternary composition described in French Pat. No. 2,182,599. In these compositions, part of the hexogen having a particle size of less than 300 μm can be replaced by fine DINGU. The compositions obtained possess all the advantages described in said French Pat. No. 2,182,599 and those mentioned in this specification. The compositions containing octogen and/or hexo-octo (that is to say crystals of hexogen and octogen which are crystallised together and obtained during the manufacture of octogen, by the French process having a particle size of less than 300 μm, therefore form part of the present invention.

Compositions according to the invention may also comprise modifying agents which are known in the field of the hexolites, for example waxes, agents for ensuring uniform crystallisation, such as hexanitrostilbene (HNS), or plasticisers, such as mononitrotoluene. However, the use of HNS is not essential in view of the excellent appearance of the compositions according to the invention.

Apart from their detonating qualities, which compare very favourably with the corresponding hexolites, the compositions according to the invention possess other very appreciable advantages for the user:

Exudation. As shown in Examples 15 to 37 below, the trinitrotoluene exudes much less in compositions containing DINGU than in compositions containing only hexogen. The use of DINGU enables an anti-exuding agent, such as polyvinyl nitrate, to be dispensed with.

Sedimentation. The compositions according to the invention produce an exceptionally small amount of sediment during charging by casting. The homogeneity of the charges is substantially improved and the density gradient is substantially eliminated. A considerable reduction in the size of the top layer results.

Degradation on successive melting operations. The compositions according to the invention retain a substantially constant low viscosity when they are subjected to melting cycles which reproduce the conventional charging conditions for hexolites. It is known that a disadvantage of conventional hexolites is the increase in their viscosity after a small number of melting operations.

Sensitivity to the impact of bullets. It is lower than that of hexolites. It is not possible to obtain positive results (i.e. detonation) with conventional tests for this property; this also applies to more rigorous tests (i.e. with very high speed firings).

Crushing strength. This is greater for compositions according to the invention than for the corresponding hexolites (by about 25%).

Evenness of texture and cracking. After melting, the compositions according to the invention have an attractive appearance and a fine and even texture. They exhibit practically no cracking.

By virtue of their performance, the compositions according to the invention can be used in all the applications known for hexolites and, because DINGU is less expensive than hexogen, they provide new prospects for this type of explosive. Furthermore, the use of DINGU having a fine particle size (of less than 10 μm) is particularly advantageous, the conventionally synthesised crude DINGU being in this form.

In order that the invention may be more fully understood, the following examples (some of which are not in accordance with the invention are are given for the purpose of comparison) are given by way of illustration.

EXAMPLES 8 to 14

Several compositions according to the invention were prepared by casting, the DINGU being introduced into the molten TNT at the same time as the hexogen.

For each of the compositions prepared, the density and the detonation rate were measured and the shattering properties were calculated. The results are given in Table II.

TABLE II

| Ex. No. | TNT (%) | RDX (%) | DTNGU (%) | Density | Detonation rate (km/second | Shattering properties |
|---|---|---|---|---|---|---|
| 8 | 25.3 | 63.9 | 10.8 | 1.7615 | 8.092 | 115.3 |
| 9 | 25.4 | 69.4 | 11.2 | 1.7615 | 8.118 | 116.1 |
| 10 | 28.6 | 54.5 | 16.9 | 1.767 | 8.030 | 113.9 |
| 11 | 28.7 | 54.7 | 16.6 | 1.767 | 7.975 | 112.4 |
| 12 | 31.4 | 54.7 | 13.9 | 1.761 | 7.910 | 110.2 |
| 13 | 38.1 | 31.5 | 30.4 | 1.766 | 7.710 | 105.0 |
| 14 | 38.3 | 30.8 | 30.9 | 1.768 | 7.726 | 105.5 |

EXAMPLES 15 to 37

(In this series of examples, Examples 16, 18, 20, 27–30, 32, 33, 35 and 36 show the use of compositions according to the invention and the remaining examples are given for the purpose of comparison.)

Exudation tests were carried out as follows. The composition to be tested was melted at 85° C. and poured into a steel mould which had been pre-heated to about 50° C. up to the brim. The upper part of this cylindrical mould (bore 21 mm, height 40 mm) had the shape of a funnel.

When it had completely cooled, the composition was withdrawn from the mould and the upper part, in the shape of a funnel, was cut off so as to leave only the cylinder having a height of 40 mm. The roughnesses on the lower part of this cylinder were removed by rubbing this part for a short time on a surface of (laminated) wood.

Squares of constant weight and having sides of 90 mm were cut out of dry filter paper, and the sample was placed in the centre of a first quarter of the square of filter paper, which was supported, with the smooth side facing upwards, on a glass plate with a flat surface. 3 or 4 successive 16 hour cycles at 70° C. were carried out, measuring the diameter of the spot and the increase in the weight of the paper after each cycle. The results obtained are summarised in Table III.

TABLE III

| No. | TNT | RDX 315–800 μm | RDX 2–10 μm | DINGU 1–20 μm | 1st cycle mm | 1st cycle mg | 2nd cycle mm | 2nd cycle mg | 3rd cycle mm | 3rd cycle mg | 4th cycle mm | Total loss in weight (mg) | Summed diameters (mm) |
|---|---|---|---|---|---|---|---|---|---|---|---|---|---|
| 15 | 40 | 48 | 12 | — | 32 | 126 | 30 | 51 | 23 | 44 | 22 | 221 | 107 |
| 16 | 40 | 48 | — | 12 | 24 | 32 | 22 | 6 | 21 | 12 | 21 | 50 | 88 |
| 17 | 40 | 42 | 18 | — | 34 | 102 | 33 | 52 | 25 | 28 | 23 | 182 | 115 |
| 18 | 40 | 42 | — | 18 | 21 | 20 | 21 | 2 | 21 | 4 | 21 | 206 | 84 |
| 19 | 40 | 30 | 30 | — | 28 | 79 | 26 | 2 | 23 | 16 | 24 | 97 | 101 |
| 20 | 40 | 30 | — | 30 | 21 | 18 | 21 | 1 | 21 | 2 | 21 | 201 | 84 |
| 21 | 40 | 60 | — | — | 33 | 166 | 31 | 20 | 23 | 46 | 23 | 232 | 110 |

A further series of experiments was carried out at 70° C. (Table IV), the duration of the cycle being 20 hours. The loss in weight of the sample was measured. Hexogen was used in some of the compositions, which had a very fine particle size, of about 3 microns, equal to the modal value of the particle size of the DINGU used. Hexolite additives, hexanitrostilbene (HNS) and polyvinyl nitrate (PVN), were also included in some of the compositions.

TABLE IV

| No. | TNT | RDX 315–800 μm | RDX 1.5–6 μm | DINGU 1–20 μm | PVN | HNS | Losses in weight: total mg | after 1st cycle mg | after 2nd cycle mg | after 3rd cycle mg | after 4th cycle mg |
|---|---|---|---|---|---|---|---|---|---|---|---|
| 22 | 40 | 54 | 6 | — | — | — | 57 | 19 | 10 | 12 | 16 |
| 23 | 40 | 48 | 12 | — | — | — | 59 | 21 | 15 | 12 | 11 |
| 24 | 40 | 60 | — | — | — | — | 54 | 21 | 11 | 11 | 11 |
| 25 | 40 | 42 | 18 | — | — | — | 52 | 17 | 13 | 12 | 10 |
| 26 | 40 | 30 | 30 | — | — | — | 43 | 15 | 10 | 10 | 8 |
| 27 | 40 | 54 | — | 6 | — | — | 33 | 11 | 8 | 8 | 6 |
| 28 | 40 | 8 | — | 12 | — | — | 34 | 12 | 8 | 8 | 6 |
| 29 | 40 | 42 | — | 18 | — | — | 28 | 9 | 5 | 8 | 6 |
| 30 | 40 | 30 | — | 30 | — | — | 27 | 8 | 6 | 7 | 6 |
| 31 | 39.8 | 53.7 | 6 | — | — | 0.5 | 58 | 18 | 16 | 13 | 11 |
| 32 | 39.8 | 53.7 | — | 6 | — | 0.5 | 25 | 9 | 5 | 6 | 5 |
| 33 | 39.7 | 53.6 | — | 6 | — | 0.7 | 33 | 13 | 8 | 4 | 8 |

TABLE IV-continued

| No. | TNT | RDX 315-800 μm | RDX 1.5-6 μm | DINGU 1-20 μm | PVN | HNS | Losses in weight total mg | after 1st cycle mg | after 2nd cycle mg | after 3rd cycle mg | after 4th cycle mg |
|---|---|---|---|---|---|---|---|---|---|---|---|
| 34 | 39.7 | 53.7 | 6 | — | 0.6 | — | 27 | 9 | 7 | 7 | 4 |
| 35 | 39.7 | 53.7 | — | 6 | 0.6 | — | 22 | 6 | 7 | 6 | 3 |
| 36 | 39.6 | 53.4 | — | 6 | 1.0 | — | 25 | 9 | 6 | 6 | 4 |
| 37 | 39.7 | 59.7 | — | — | 0.6 | — | 29 | 10 | 7 | 7 | 5 |

The foregoing tests with compositions, some of which comprised a fine hexogen fraction, show that these compositions were subject to significant exudation.

On the other hand, when DINGU was used, the exudation was reduced by 40 to 90%. The visual comparison of the filter papers from each test was spectacular: the exudation was practically zero when at least 15% by weight of DINGU was used.

It is known that the incorporation of a small amount of PVN has the effect of reducing the exudation of hexolites. This is confirmed by Example 34. Nevertheless, it can be seen, for example from Examples 29, 30 and 32, that the use of DINGU enables PVN to be dispensed with in order to reduce exudation.

Examples 35 and 36 show that the effects of DINGU and PVN are slightly additive from the point of view of exudation.

Example 31 shows that HNS has no influence on the exudation of hexolites. The incorporation of HNS into compositions according to the invention does not detract from the improvement in exudation provided by DINGU.

EXAMPLES 38 to 40

(In this series of examples, only Example 40 is in accordance with the invention, the other two examples being given for the purpose of comparison.)

Sedimentation tests were carried out so as to judge the behaviour of the explosive according to the invention during the charging of ammunition.

The test consisted of melting the mixture in a stirred vat at 90° C. and removing it from the vat. The molten mixture was then cast into steel tubes, having a length of 200 mm and an internal diameter of 50 mm, which were slightly conical and were pre-heated to 90° C. Sedimentation was allowed to proceed for 3 hours, after which cooling to 50° C. was carried out in 25 mm stages, every 30 minutes. After 3 hours, the moulded article was withdrawn, the top layer of TNT was removed and the remaining piece was cut into three equal parts, the density of which was measured.

The results are summarised in Table V which follows:

TABLE V

| No. | TNT | RDX 315-800 μ | RDX 2-10 μ | RDX 1.5-6 μ | Technical grade DINGU | Thickness of TNT (mm) | Mean density | Density at top | Density in middle | Density at bottom |
|---|---|---|---|---|---|---|---|---|---|---|
| 38 | 40 | 30 | 30 | — | — | 5 | 1.705 | 1.696 | 1.702 | 1.715 |
| 39 | 40 | 30 | — | 30 | — | 8 | 1.727 | 1.720 | 1.726 | 1.735 |
| 40 | 40 | 30 | — | — | 30 | 1 | 1.758 | 1.755 | 1.758 | 1.761 |

The DINGU used came from a batch manufactured on an industrial scale by the process of French Pat. No. 2,238,703.

The results given for Examples 38 and 39 are based on measurements carried out on two tubes; Example 40 refers to the mean of 4 tubes.

It is seen that the production of a sediment of TNT is reduced by about 80% and that the difference betweem the extreme densities of the charge, which is of the order of 1% in the case of the hexolites, is three times smaller in the case of the composition according to the invention if the top layer of TNT is removed, and four times smaller if the latter is not removed. It follows from these results that the top layer can be substantially reduced by means of the invention (the top layer is the upper, less rich part of the charge which the charger must remove and recycle).

EXAMPLES 41 to 47

A composition according to the invention, consisting, by weight, of 40% of TNT, 54% of hexogen and 6% of fine DINGU (particle size 1-10 microns), was prepared. Several successive re-melting operations were carried out at 85° C. on this composition and its viscosity was measured on an EFFLUX viscometer (diameter of the flow orifice: 0.5 inch, that is to say about 1.2 cm). The following results, expressed in flow times (in seconds), were obtained.

| No. of flow test | 1 | 2 | 3 | 4 | 5 | 6 | 7 | 8 | 9 | 10 | 11 | 12 |
|---|---|---|---|---|---|---|---|---|---|---|---|---|
| Viscosity (seconds) | 5.0 | 5.1 | 4.9 | 4.8 | 4.6 | 4.7 | 4.6 | 4.5 | 4.5 | 4.4 | 4.6 | 4.7 |

By way of comparison, a hexolite of the same composition, but in which the DINGU fraction was replaced by a hexogen of the same particle size, had a viscosity of 27 seconds after the second melting operation, all conditions being otherwise the same.

Compositions according to the invention having an increasing proportion of DINGU and a constant proportion of TNT, that is 40% by weight, were prepared, and their viscosity was measured at 85° C. The results are summarised below.

| No. | RDX % | DINGU % | EFFLUX viscosity (seconds) |
|---|---|---|---|
| 42 | 60 | — | 9 |
| 43 | 54 | 6 | 3.6 |
| 44 | 48 | 12 | 3.2 |

-continued

| No. | RDX % | DINGU % | EFFLUX viscosity (seconds) |
|---|---|---|---|
| 45 | 45 | 15 | 3.2 |
| 46 | 36 | 24 | 3.8 |
| 47 | 30 | 30 | 5.3 |

It is found that compositions according to the invention degrade to an extremely small extent during successive re-melting operations, which is an appreciable advantage for chargers.

As regards compositions containing a high proportion of crystalline explosive, it was found that a composition containing only 25% by weight of TNT, 55% by weight of hexogen (375–800 microns), and 20% by weight of fine DINGU was castable (viscosity: 20 seconds at 85° C.), dense (d=1.77) and very homogeneous.

EXAMPLES 48 to 51

The compositions according to the invention have an excellent insensitivity to the impact of bullets; they did not give any positive result in conventional tests. The following compositions Nos. 48 to 50 were cast into a container having dimensions 60×50×40 mm, made of 0.5 mm thick sheet metal and provided with a 10 mm thick anvil. A 7.62 mm calibre bullet was fired into the sample at speeds of 890 to 910 m/second. No positive result was found for any batch of five blocks.

No. 48: 40% TNT, 30% RDX, 30% DINGU,

No. 49: 40% TNT, 45% RDX, 15% DINGU,

No. 50: 30% TNT, 53% RDX, 17% DINGU, all proportions by weight.

For conventional 70/30 or 60/40 hexolites, positive results have already been recorded for these bullet speeds.

The test has been made more rigorous for the compositions according to the invention. A steel tube was used which had a length of 70 mm and diameters of 41/49 mm and which was sealed at one end by a 5 mm welded steel plate and at the other end by a cast iron cap. Firings were carried out with a 7.62 mm bullet, radially and at very high speed (1,260 m/second).

No positive result was obtained with composition No. 48 over ten firings, and no positive result was obtained over 5 firings with composition No. 51 comprising 15% of TNT, 40% of RDX and 45% of DINGU, all by weight.

EXAMPLE 52

The crushing strength of 10×10×10 mm cubes of 60/40 hexolite (comprising 30% of hexogen, 2–10 microns) and of a 30/30/40 composition according to the invention, that is containing 30% by weight of RDX, 30% by weight of DINGU and 40% by weight of TNT, were compared under the same conditions.

A mean crushing strength of 192 bars (maximum: 220 bars) was obtained for six samples of the hexolite (which had a mean density of 1.727).

A mean strength of 253 bars (maximum: 300 bars) was obtained for six samples of the corresponding composition according to the invention (which had a mean density of 1,760).

In this test, compression was carried out between two parallel faces, the crushing rate being 1 mm/minute.

What is claimed is:

1. An explosive composition which comprises trinitrotoluene, cyclotrimethylene trinitramine and dinitroglycoluril.

2. An explosive composition as set forth in claim 1, which contains, by weight, from 10 to 60% of trinitrotoluene, from 10 to 85% of cyclotrimethylene trinitramine and from 5 to 50% of dinitroglycoluril.

3. An explosive composition as set forth in claim 1, wherein said dinitroglycoluril has a particle size of less than 10 microns.

4. An explosive composition as set forth in claim 1, which additionally comprises at least one crystalline explosive having a particle size of less than 300 microns, said crystalline explosive being selected from the group consisting of cyclotetramethylene tetranitramine and a co-crystallized mixture of cyclotrimethylene trinitramine and cyclotetramethylene tetranitramine.

5. An explosive charge containing an explosive composition as set forth in claim 2.

* * * * *

UNITED STATES PATENT OFFICE

CERTIFICATE OF CORRECTION

Patent No. 4,148,674 Dated April 10, 1979

Inventor(s) Jean-Paul A. Kehren et al.

It is certified that error appears in the above-identified patent and that said Letters Patent are hereby corrected as shown below:

Column 1, lines 46-57, should read as follows:

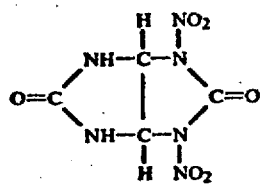

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*